US006305523B1

(12) United States Patent
House et al.

(10) Patent No.: US 6,305,523 B1
(45) **Date of Patent: *Oct. 23, 2001**

(54) COIN DISCRIMINATING APPARATUS

(75) Inventors: Larry J. House; Richard J. Davis, both of Columbus, OH (US)

(73) Assignee: Japan Tobacco Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/425,688

(22) Filed: Oct. 22, 1999

(51) Int. Cl.[7] ..... G07D 5/08

(52) U.S. Cl. ..... 194/317; 174/318; 174/328; 174/330

(58) Field of Search ..... 194/317, 318, 194/328, 330

(56) References Cited

U.S. PATENT DOCUMENTS

| | | | | |
|---|---|---|---|---|
| 3,870,137 | * | 3/1975 | Fougere | 194/317 |
| 5,489,015 | * | 2/1996 | Wood | 194/318 |
| 5,568,854 | * | 10/1996 | Hayes et al. | 194/318 |
| 5,687,830 | * | 11/1997 | Hayes et al. | 194/318 |
| 5,743,373 | * | 4/1998 | Strauts | 194/318 |
| 5,871,075 | * | 2/1999 | Takayama et al. | 194/318 |

FOREIGN PATENT DOCUMENTS

| | | | | |
|---|---|---|---|---|
| 2169429 A | * | 7/1986 | (GB) | 194/317 |
| 10-116368 | | 5/1998 | (JP) . | |
| 11-051905 | | 2/1999 | (JP) . | |
| 11-250304 | | 9/1999 | (JP) . | |

* cited by examiner

*Primary Examiner*—Eileen D. Lillis
*Assistant Examiner*—Thuy V. Tran

(57) ABSTRACT

A coin discriminating apparatus in which, to permit easy and reliable determination of the denomination and authenticity of a coin, information on surface displacement irregularities of a stamp pattern on a coin surface is detected, and features of the stamp pattern represented by the surface displacement irregularities information are plotted in the form of a histogram indicative of distribution of the surface displacement irregularities over the entire surface of the coin. The histogram is compared with a histogram of surface displacement irregularities distribution obtained beforehand with respect to a true coin to identify the denomination of the coin, thereby eliminating the need for a complicated process such as rotation of the stamp pattern (image information) on the coin surface. Preferably, eddy current induction coils are used to apply high-frequency electromagnetic field to a coin to induce eddy current therein, and impedances of the coils, that vary depending on the eddy current induced in the coin, are detected as the surface displacement irregularities information. Then, distribution of the detected impedances over the entire surface of the coin is obtained in the form of a histogram showing impedance along the abscissa and the numbers of eddy current induction coils with outputs in specified ranges along the ordinate. Also, based on the detected impedances, the material, diameter and thickness of the coin are determined for the coin discrimination.

7 Claims, 8 Drawing Sheets

| DENOMINATION | OUTER DIAMETER | MATERIAL (IMPEDANCE) | THICKNESS | SURFACE DISPLACEMENT (HISTOGRAM) |
|---|---|---|---|---|
| 500YEN | 27mm$^{\phi}$ | $Z_{500}$ | 1.80mm | Z |
| 100YEN | 22mm$^{\phi}$ | $Z_{100}$ | 1.70mm | Z |
| 50YEN | 20mm$^{\phi}$ | $Z_{50}$ | 1.75mm | Z |
| 10YEN | 23mm$^{\phi}$ | $Z_{10}$ | 1.50mm | Z |

COIN DISCRIMINATING APPARATUS

BACKGROUND OF THE INVENTION

1. Field of the Invention

The present invention relates to a coin discriminating apparatus capable of determining with high accuracy the denomination and authenticity of a coin by a simple process based on information on surface displacement irregularities of a stamp (strike) pattern on a coin surface. More particularly, the invention relates to a coin discriminating apparatus wherein a histogram of surface displacement irregularities information indicative of a stamp pattern on a surface of a coin is created as feature information and is collated with a histogram obtained beforehand with respect to a true coin (one of coins to be handled), thereby to identify the authenticity and denomination of the coin with high accuracy based on the stamp pattern on the coin surface.

2. Description of the Related Art

In vending machines, automatic teller machines (ATMs), etc., a coin discriminating apparatus is incorporated to determine the denomination and authenticity of coins, as a process preliminary to the calculation of the sum of inserted coins. This type of coin discriminating apparatus is generally designed to measure the outer diameter, thickness and weight of a coin and compare the measured values with previously obtained outer diameter, thickness and weight of a true coin (one of coins of different denominations to be handled) to determine the denomination of the coin, and nonauthentic coins are rejected. Among a diversity of coins, however, there are coins, for example, coins used in foreign countries, that should not be accepted but yet have features (outer diameter, thickness, weight) resembling those of true coins to be accepted, and such coins can be erroneously judged to be authentic.

Attempts have therefore been made to acquire, in the form of an image, information on surface displacement irregularities of a stamp pattern on a coin surface and recognize features of the image, thereby to identify the denomination of the coin. However, in cases where the features (pattern) of an image showing the stamp pattern on a surface of a coin to be discriminated are compared with those (pattern) of an image showing the stamp pattern of a true coin, it is necessary that a matching process be performed following the rotation of the image for comparison, or that an extra process such as Fourier transform be performed as needed. Thus, a complicated process is required for the discrimination of coins and the process consumes much time.

SUMMARY OF THE INVENTION

The object of the present invention is to provide a coin discriminating apparatus wherein, to permit easy and reliable determination of the denomination and authenticity of a coin, information on surface displacement irregularities of a stamp pattern on a surface of a coin is acquired, features of the stamp pattern represented by the surface displacement irregularities information are obtained as a histogram of distribution of surface displacement irregularities over the entire surface of the coin, and the histogram is compared with a previously obtained histogram indicative of distribution of surface displacement irregularities of a true coin, to determine the denomination of the coin.

Specifically, the present invention utilizes the surface displacement irregularities information indicative of features of a stamp pattern on a surface of a coin, and is characterized in that the features of the stamp pattern on a coin surface are acquired exactly as a histogram of frequency distribution of surface displacement irregularities over the entire surface of the coin, thereby permitting easy and high-accuracy determination of the denomination and authenticity of the coin. The present invention is characterized in particular in that the denomination of a coin can be discriminated without the need to perform a complicated process such as rotation of the stamp pattern (image information) on the coin surface represented by the surface displacement irregularities information or complex mechanical manipulation of the coin for coin image registration with the stored image orientation.

According to one embodiment of the present invention, a sensor for obtaining information on surface displacement irregularities of a stamp pattern on a coin surface comprises a plurality of eddy current induction coils for respectively locally applying high-frequency electromagnetic field to a coin and collectively covering the entire surface thereof to induce eddy current in the coin, and impedance measuring means for detecting impedances of the eddy current induction coils that vary depending on the eddy current induced in the coin. Using the detected impedances as surface displacement irregularities information, distribution of the impedances over the entire surface of the coin is plotted in the form of a histogram showing the impedance along the abscissa and the numbers of eddy current induction coils along the ordinate, thereby acquiring features of the surface displacement irregularities.

Preferably, the eddy current induction coils are arranged on a plane in a rectangular grid form to constitute a coil array, and the coil array is arranged so as to face a surface of a coin.

According to another embodiment of the present invention, the sensor for obtaining information on surface displacement irregularities of a stamp pattern on a coin surface comprises a light source for diffusely illuminating a surface of a coin with light, and a plurality of optical sensors for detecting light rays which are reflected from the surface of the coin after being emitted from the light source. Using the intensities of the reflected light rays obtained by the optical sensors as the surface displacement irregularities information, distribution of the intensities of the reflected light rays over the entire surface of the coin is plotted in the form of a histogram showing the reflected light intensity along the abscissa and the numbers of optical sensors with a response in a specified range along the ordinate.

According to still another embodiment of the present invention, the aforementioned sensor comprises a light source for illuminating a surface of a coin with light, and an image sensor for acquiring an image of the surface of the coin illuminated by the light source. Using luminance signals in image signals obtained by the image sensor as the surface displacement irregularities information, distribution of the luminance signal levels over the entire surface of the coin is plotted in the form of a histogram showing the luminance signal level along the abscissa and the numbers of pixels with luminance levels in a specified range along the ordinate.

A coin discriminating apparatus according to a preferred embodiment of the present invention further comprises an eddy current induction coil for applying low-frequency electromagnetic field to a coin to induce eddy current therein, impedance measuring means for detecting an impedance of the eddy current induction coil that varies depending on the eddy current induced in the coin, and material determining means for comparing the detected impedance of the eddy current induction coil with an impedance obtained beforehand with respect to a true coin, to determine the material of the coin. The use of the material determining means makes it possible to further enhance the coin discrimination accuracy.

According to a preferred embodiment of the present invention, the coin discriminating apparatus may further comprise coin diameter measuring means for measuring the diameter of a coin based on the impedances of the eddy current induction coils detected when the coils are excited at high frequency, and/or coin thickness measuring means for measuring the thickness of the coin based on the impedances of the eddy current induction coils excited at high frequency. The coin diameter measuring means and the coin thickness measuring means each serve to enhance the coin discrimination accuracy.

Further, according to a preferred embodiment of the present invention, specified coils in the eddy current induction coil grid that were also used for applying high-frequency electromagnetic field to the coin to induce eddy current therein may also be used to apply a low-frequency electromagnetic field to the coin to induce eddy current therein, and these specified eddy current induction coils may be selectively excited at low frequency, instead of high frequency, so that their impedances may be measured to determine the material (composition) of the coin. Alternatively a large coil embedded in the eddy current coil array grid may be used to produce the low frequency eddy currents in the coin for material composition discrimination. In the preferred embodiment, by merely measuring the impedances of the eddy current induction coils, it is possible to detect not only the material of the coin but the diameter and thickness of same based on the information on when the coin edge passes each small coil in the coil array grid, whereby high-accuracy coin discrimination can be made with a simple structure.

DETAILED DESCRIPTION OF THE PREFERRED EMBODIMENTS

Embodiments of the present invention will be hereinafter described with reference to the drawings, first taking as an example a coin discriminating apparatus in which information on surface displacement irregularities of a stamp (strike) pattern on a surface of a coin is detected by using a plurality of eddy current induction coils.

Figure 1A:
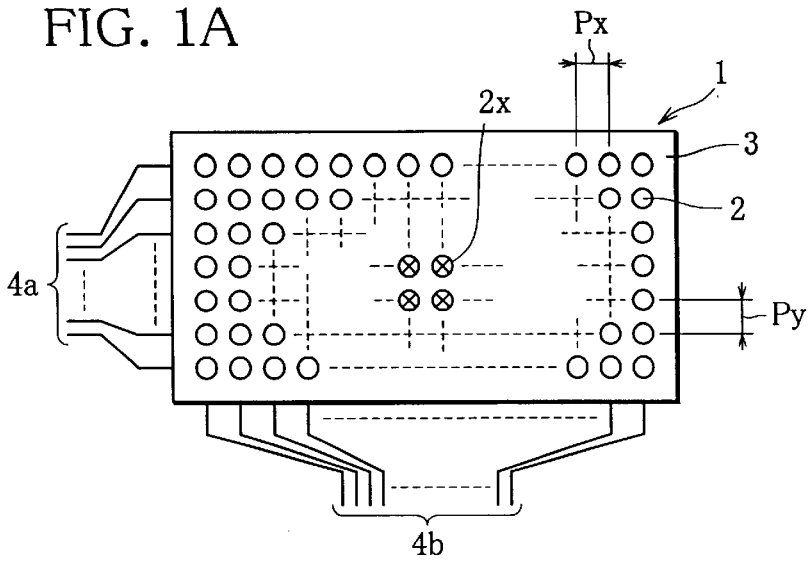
FIG. 1A is a schematic diagram showing the arrangement of a coil array incorporated in a coin discriminating apparatus according to one embodiment of the present invention.
Figure 2:
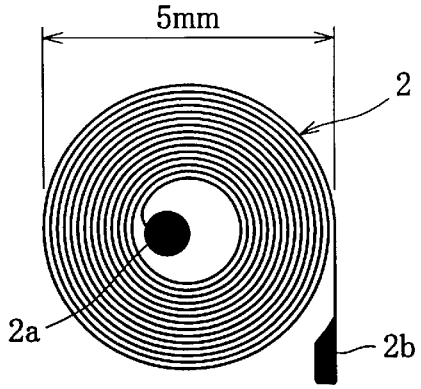
FIG. 2 is a diagram showing the construction of a flat coil (eddy current induction coil) constituting the coil array shown in FIG. 1.

FIG. 1A schematically illustrates the arrangement of a coil array 1 incorporated in a coin discriminating apparatus according to one embodiment of the present invention. The coil array 1 comprises a plurality of (m×n) eddy current induction coils 2 arranged on a plane in the form of a rectangular grid of m rows by n columns or other suitable geometric arrangement of coil array elements. Specifically, the coil array 1 is formed as a printed circuit board which includes a predetermined insulating substrate 3 having a size greater than the outer diameters of coins to be handled, for example, a size of about 30 mm×50 mm, and a plurality of flat coils (eddy current induction coils) 2 of spiral form with an outer diameter of about 2 mm to 5 mm, as shown in FIG. 2, formed on the insulating substrate 3 at a predetermined pitch $P_x$, $P_y$(e.g., about 6 mm). Each eddy current induction coil 2 has a pair of lead terminals 2*a* and 2*b*, and the corresponding lead terminals of the coils 2 of the individual rows and columns are connected together and are extended as row select lead terminals 4*a* and column select lead terminals 4*b* of the coil array 1. Thus, by selecting one of the row select lead terminals 4*a* and at the same time one of the column select lead terminals 4*b* and passing electric current between the selected lead terminals 4*a* and 4*b*, it is possible to selectively specify and excite one eddy current induction coil 2 in the coil array 1.

The eddy current induction coils 2 constituting the coil array 1 are each used to locally apply a high-frequency electromagnetic field to a coin, as described later. Specified ones of the eddy current induction coils 2 arranged in matrix form, for example, four eddy current induction coils 2*x* located approximately in the center of the matrix, are also used to apply a low-frequency electromagnetic field to a coin.

Each of the eddy current induction coils 2 (2*x*) produces a electromagnetic field (high- or low-frequency electromagnetic field) when supplied with and excited by an alternating current of predetermined frequency, and applies the electromagnetic field (alternating electromagnetic field) locally to a coin to induce an eddy current therein corresponding to the material, thickness, etc. of the coin.

The eddy current induced in the coin acts upon (exerts an influence upon) the eddy current induction coil 2 (2*x*), as described later, to change the impedance thereof. The eddy current induction coil 2 (2*x*) detects such a change in the impedance as a feature of the coin and thus functions as a sensing section.

Figure 3:
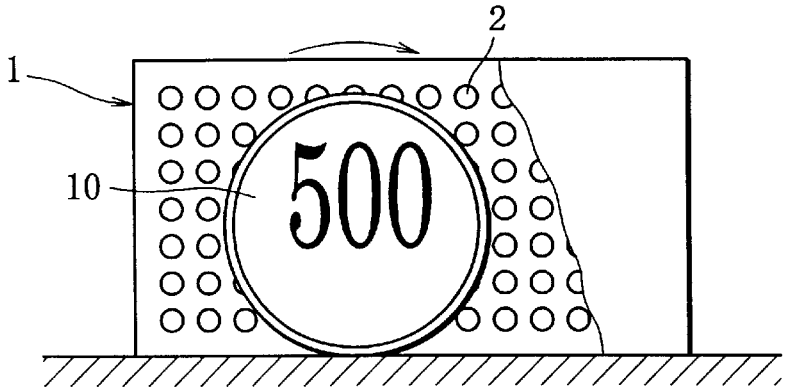
FIG. 3 is a partly broken front view showing the internal arrangement of a sensing section of the coin discriminating apparatus according to the embodiment.
Figure 4:
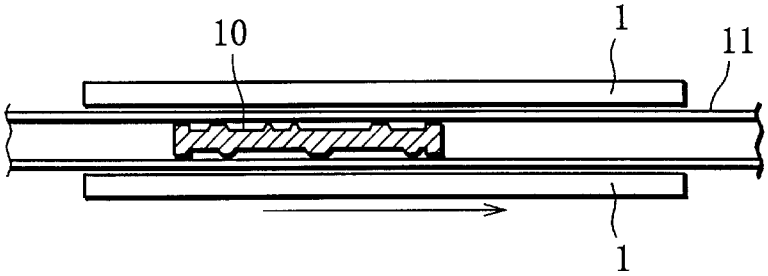
FIG. 4 is a plan view showing the sensing section as viewed from above.
Figure 5:
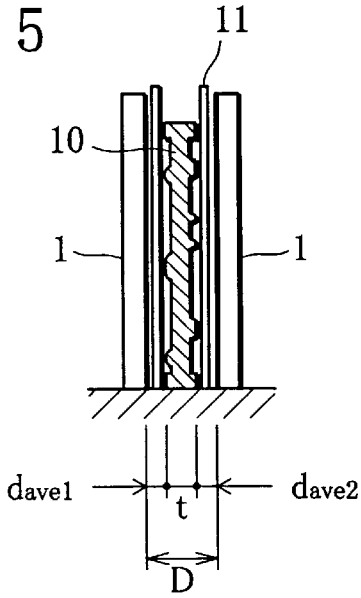
FIG. 5 is a side view showing the sensing section as viewed from a moving direction of a coin.

As seen from the arrangement of the sensing section of the coin discriminating apparatus schematically shown in FIGS. 3 to 5, two coil arrays 1, each constituted by the eddy current induction coils 2 as described above, are arranged along respective guides 11 defining a passage for a coin 10. FIG. 3 is a partly broken front view showing the internal arrangement of the sensing section, FIG. 4 is a plan view showing the sensing section as viewed from above, and FIG. 5 is a side view showing the sensing section as viewed from a moving direction of the coin 10.

As illustrated, the sensing section is constituted by the two parallel coil arrays 1 arranged on opposite sides of the coin passage defined by the guides 11. The coil arrays 1 are positioned such that their surfaces on which the eddy current induction coils 2 are arrayed respectively face the obverse and reverse sides of the coin 10 sliding along the guides 11, in a manner substantially parallel thereto. The distance, in particular, between each of the coil arrays 1 and a corresponding one of the obverse and reverse sides of the coin 10 on which irregular stamp patterns are formed is set to a very small value such that the electromagnetic field produced by the eddy current induction coil 2 acts satisfactorily intensely upon the coin 10 and also that the eddy current induced in the coin 10 exerts a sufficiently great influence upon the eddy current induction coil 2.

In the illustrated example, the sensing section is arranged at a passage along which a coin 10 slides, but it may be arranged at a passage along which a coin 10 is slid sideways or at a passage through which a coin 10 falls. The surface of each coil array 1 on which the eddy current induction coils 2 are formed may of course be covered with a protective film such that the coil arrays 1 themselves constitute part of the guides 11 defining the coin passage.

Figure 1B:
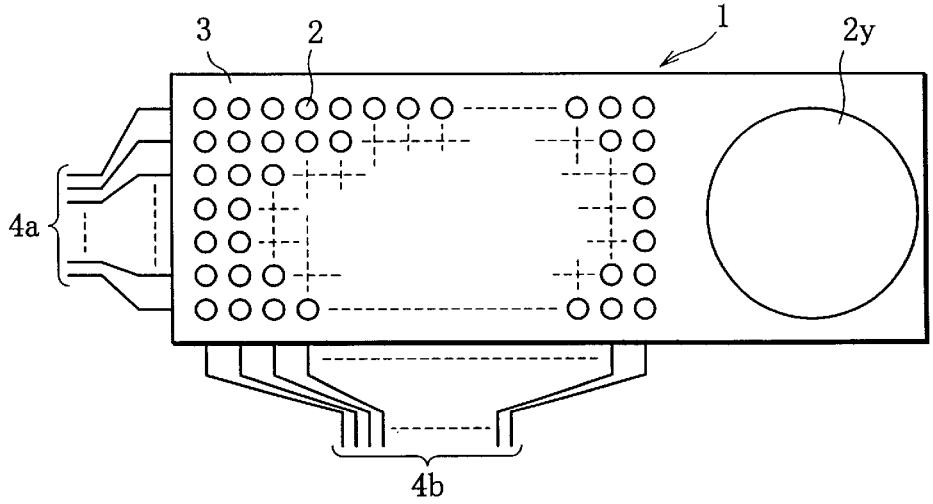
FIG. 1B is a schematic diagram showing the arrangement of a coil array and a low frequency-excited eddy current induction coil incorporated in a coin discriminating apparatus according to another embodiment of the present invention.
Figure 6A:
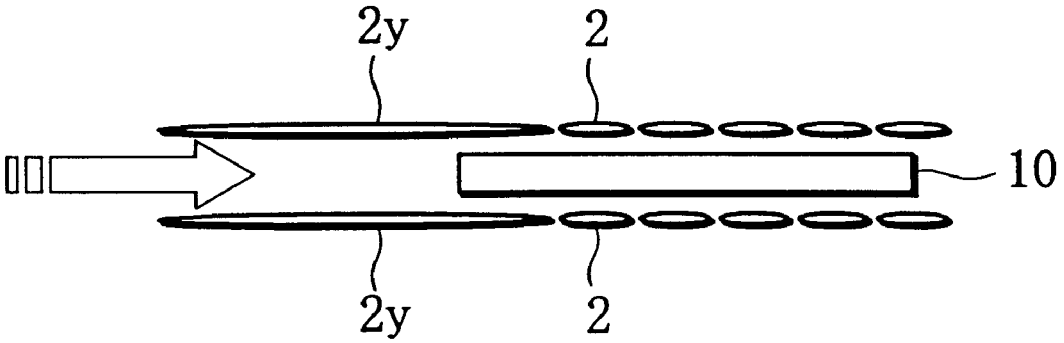
FIG. 6A is a schematic diagram showing another example of how eddy current induction coils are arranged with respect to a coin.
Figure 6B:
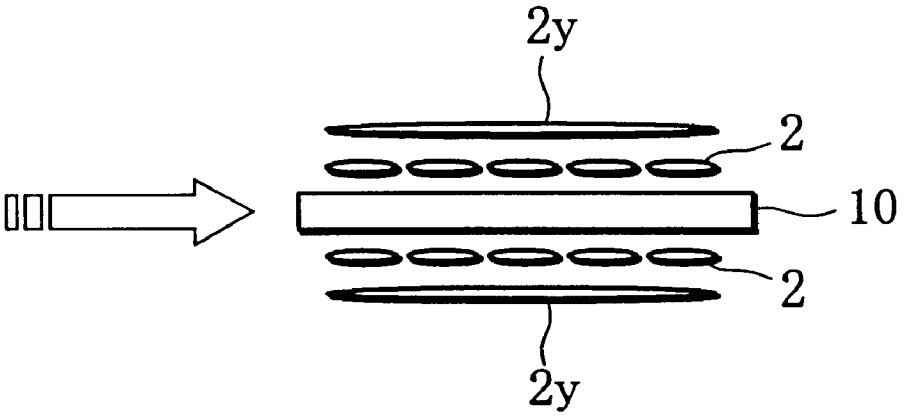
FIG. 6B is a schematic diagram showing still another example of how eddy current induction coils are arranged with respect to a coin.

The eddy current induction coils for applying low-frequency electromagnetic field to the coin 10 may be constituted by a special eddy current induction coil 2*y* as shown in FIG. 1B, for example, which is separate from the coil array 1 of high frequency-excited eddy current induction coils 2 and is arranged side by side with respect thereto. The special eddy current induction coil 2*y* may alternatively be arranged face to face with respect to the coil array 1. In this case, the low frequency-excited eddy current induction coil 2*y* preferably has a large diameter corresponding to the diameter of the coin 10. These eddy current induction coils 2, 2*x*, 2*y* may be arranged along the coin passage so as to face the coin 10, as shown in FIGS. 6A and 6B.

Figure 7:
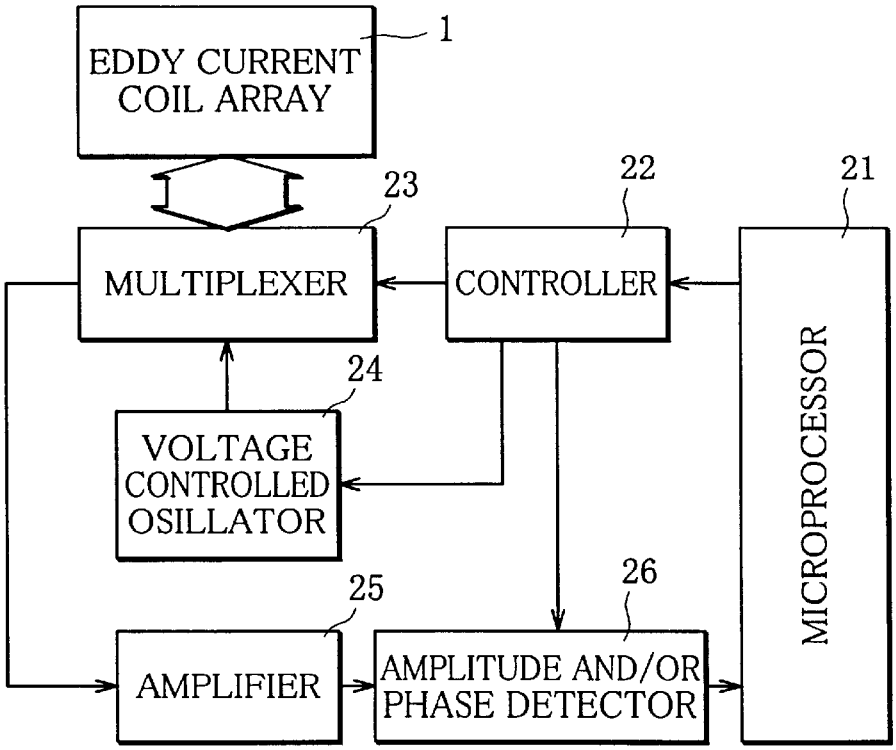
FIG. 7 is a schematic diagram showing the entire configuration of the coin discriminating apparatus according to the embodiment.

The coin discriminating apparatus, in which the individual eddy current induction coils 2 of the coil arrays 1 are excited to detect features of a coin 10 and thereby identify the denomination thereof, is generally configured as shown in FIG. 7. In the coin discriminating apparatus, a microprocessor 21 controls the operation of a controller 22, which in turn excites the individual eddy current induction coils 2 of the coil array 1 and detects features of a coin 10 as impedances of the eddy current induction coils 2 that vary depending on the coin 10, in the manner described below. In accordance with the detected impedances of the eddy current induction coils 2, in particular, in accordance with information on surface displacement irregularities (features of a stamp pattern) on the surface of the coin 10 obtained as a distribution of the impedances, the denomination and authenticity of the coin 10 are determined.

Specifically, the controller 22 drives a multiplexer 23 to successively select the eddy current induction coils 2 of the coil array 1 and at the same time causes an current of predetermined frequency, output from a voltage-controlled oscillator (VCO) 24, to be applied to the then selected eddy current induction coil 2, thereby exciting the selected eddy current induction coil 2. In accordance with a clock signal CLK of predetermined frequency generated from the controller 22, for example, the multiplexer 23 cyclically and successively selects the column select lead terminals 4*b* of the coil array 1, one at a time, and allows the output (alternating current) of the voltage-controlled oscillator 24 to be applied to the then selected column of eddy current induction coils 2. Simultaneously, the multiplexer 23 selectively connects one of the row select lead terminals 4*a* of the coil array 1 to the ground in a manner such that each time one cyclic selection of all the column select lead terminals 4*b* is completed, the row select lead terminal 4*a* to be grounded is switched from one to another. Owing to such selection of the rows and columns of the coil array 1 by the multiplexer 23, the eddy current induction coils 2 arranged in a rectangular grid or other suitable array geometry form are successively selected, one at a time, to be excited with current supplied thereto from the voltage-controlled oscillator 24. Namely, the array of the eddy current induction coils 2 is scanned two-dimensionally for excitation.

The terminal voltage (amplitude and/or phase) of the eddy current induction coil 2 selected and excited by the multiplexer 23 is detected through an amplifier 25 as the output (alternating current) of the voltage-controlled oscillator 24 selectively applied to the column select lead terminals 4*b* of the coil array 1, for example. The amplifier 25 serves to detect a change in impedance of the eddy current induction coil 2 as a change in amplitude and/or phase of the signal (output of the voltage-controlled oscillator 24) for exciting the eddy current induction coil 2. A induction coil impedance amplitude and/or phase detector circuit 26 samples the output of the amplifier 25 in synchronism with the operation timing of the multiplexer 23 operated by the controller 22, that is, in synchronism with the selection of the eddy current induction coils 2, and holds the sampled value, which is then collected and stored by the microprocessor 21.

When a coin 10 is introduced to the sensing section, the controller 22 controls the operation of the multiplexer 23 in accordance with a command supplied thereto from the microprocessor 21 so that all of the eddy current induction coils 2 of the coil array 1, for example, may first be successively excited. In this case, the controller 22 applies a first control voltage to the voltage-controlled oscillator 24 and drives the oscillator 24 to oscillate at a frequency of about 1 MHz. Consequently, all of the eddy current induction coils 2 are successively excited at a high frequency of about 700 kHz or higher. When the high-frequency excitation of all the eddy current induction coils 2 is completed, the controller 22 then controls the operation of the multiplexer 23 so that only the aforementioned specified eddy current induction coils 2*x* may be successively excited. In this case, the controller 22 applies a second control voltage to the voltage-controlled oscillator 24 and drives the same to oscillate at a frequency of about 100 kHz. Consequently, only the specified eddy current induction coils 2*x* are simultaneously excited at a low frequency of about 100 kHz to 700 kHz. Thus, the voltage-controlled oscillator 24 selectively functions as high-frequency exciting means for exciting the eddy current induction coils 2 at high frequency and low-frequency exciting means for exciting the eddy current induction coils 2*x* at low frequency, in cooperation with the controller 22.

Alternatively, when any one of the specified eddy current induction coils 2*x* is selected in the process of successive selection of the eddy current induction coils 2 for high-frequency excitation, the operation of the voltage-controlled oscillator 24 may be controlled synchronously such that the selected eddy current induction coil 2*x* is excited at low frequency. Namely, settings may be made beforehand such that the specified eddy current induction coils 2*x* are excited at low frequency while the other eddy current induction coils 2 are excited at high frequency, in which case scanning of the entire coil array 1 is completed as soon as the eddy current induction coils 2 (2*x*) of the coil array 1 are successively excited only once.

The oscillation amplitudes of the individual eddy current induction coils 2 (2*x*) excited with the excitation condition varied in this manner are successively detected via the amplifier 25 and the amplitude and/or phase detector circuit 26 as information indicative of the impedances of the eddy current induction coils 2 (2*x*) that vary according to the coin 10. Namely, the amplifier 25 is used as impedance measuring means for the eddy current induction coils 2 (2*x*).

The following explains how the impedances of the eddy current induction coils 2 (2*x*) vary according to a coin 10.

Figure 8:
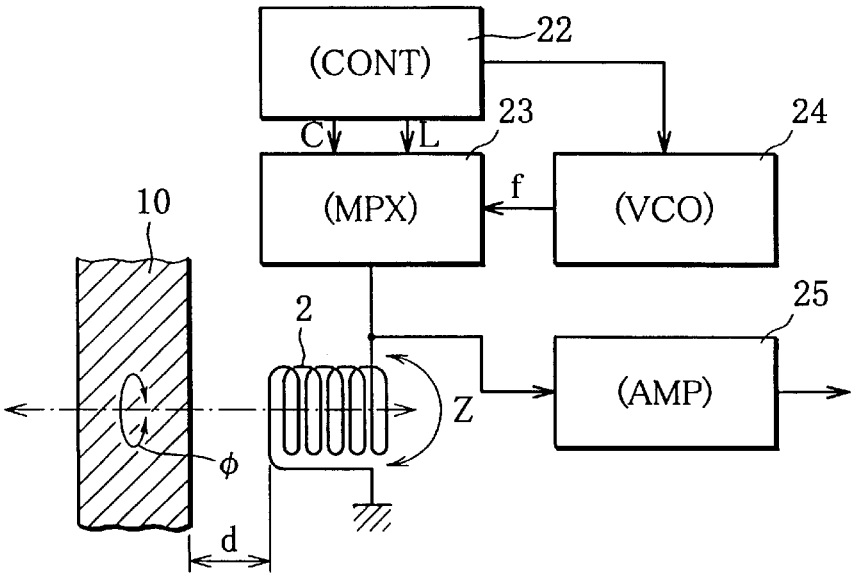
FIG. 8 is a diagram schematically showing the relationship between an eddy current induction coil of the coin discriminating apparatus and a coin to which an alternating electromagnetic field is locally applied from the eddy current induction coil.

FIG. 8 schematically shows the relationship between one eddy current induction coil 2 which is selectively supplied with and excited by the output from the voltage-controlled oscillator 24 under the control of the multiplexer 23, and a coin 10 to which an alternating electromagnetic field is locally applied from the eddy current induction coil 2. When the coin 10 is applied with an alternating electromagnetic field $\phi$ produced by the eddy current induction coil 2, an eddy current $I_c$ is induced in a portion of the coin 10 where the alternating electromagnetic field intersects. The magnitude of the induced eddy current $I_c$ varies depending on the material composition and thickness of the coin 10 and the distance of the induction coil from the coin 10. Also, the electromagnetic flux produced by the eddy current $I_c$ acts so as to cancel out the alternating electromagnetic flux produced by the eddy current induction coil 2. Accordingly, the electromagnetic flux produced by the eddy current induction coil 2 is virtually reduced even if the electric current for exciting the eddy current induction coil 2 is constant, so that the inductance, that is, the impedance Z of the eddy current induction coil 2 decreases. In other words, when an alternating electromagnetic field is applied to the coin 10 from the eddy current induction coil 2 to induce eddy current in the coin 10, the impedance of the eddy current induction coil 2 lowers under the influence of the induced eddy current. Further, the smaller the distance d between the eddy current induction coil 2 and the surface of the coin 10, the greater influence the electromagnetic flux produced by the eddy current $I_c$ exerts upon the eddy current induction coil 2, causing a greater drop in the impedance of the coil 2.

By acquiring such a change in the impedance of the eddy current induction coil 2 as a change in the amplitude and/or phase of the signal for exciting the coil 2, the amplifier 25 detects the impedance of the eddy current induction coil 2. The impedance of the eddy current induction coil 2 that varies under the influence of the eddy current induced in the coin 10, in particular, is dependent not only on the material of the coin 10 but also on surface displacement irregularities of the stamp pattern on the coin surface, and consequently on variations in the distance d of the coin 10 from the coil 2. It is therefore possible to extract features of the coin 10 by detecting the impedances of the eddy current induction coils 2.

As the frequency of the alternating electromagnetic field produced by the eddy current induction coil 2 increases, the eddy current is induced in a region of the coin 10 closer to its surface. Conversely, as the frequency of the alternating electromagnetic field decreases, the electromagnetic field is able to penetrate deeper in the interior of the coin 10 and the eddy current is induced in the inner part. Accordingly, to obtain information on surface displacement irregularities of the stamp pattern on the coin surface, the eddy current induction coil 2 may be excited at a high frequency of, for example, about 700 kHz to 1 MHz so that the eddy current may be induced in the surface of the coin 10 having surface displacement irregularities forming the stamp pattern. By thus making the eddy current $I_c$ induced in the surface of the coin 10, the eddy current induction coil 2 is greatly influenced by the eddy current $I_c$ in accordance with the distance d of the coil 2 to the coin 10 that varies depending upon the surface displacement irregularities on the coin surface, with the result that the impedance of the coil 2 greatly varies. Consequently, based on variations in the impedance of the eddy current induction coils 2, it is possible to effectively detect the surface displacement irregularities of the stamp pattern on the surface of the coin 10.

On the other hand, to obtain information on the material (composition) of the coin 10, the excitation frequency for the eddy current induction coil 2 may be set to a low frequency of, for example, 10 kHz to 100 kHz so that the eddy current $I_c$ may be induced in the inner part of the coin 10 and may greatly vary depending on the material of the coin 10. By thus making the eddy current $I_c$ induced in the inner part of the coin 10, the eddy current induction coil 2 is scarcely affected by variations in the distance d to the coin 10 due to the surface displacement irregularities, and is influenced only by the magnitude of the eddy current $I_c$ induced in the inner part of the coin 10. The magnitude of the eddy current $I_c$ induced in the inner part of the coin 10 greatly varies depending on the material of the coin 10. Consequently, based on variation in the impedance of the eddy current induction coil 2, it is possible to obtain information on the material of the coin 10.

The excitation condition (excitation frequency) for the eddy current induction coils 2, which is set by controlling the operation of the voltage-controlled oscillator 24 as mentioned above, is determined based on the knowledge described above.

Figure 9:
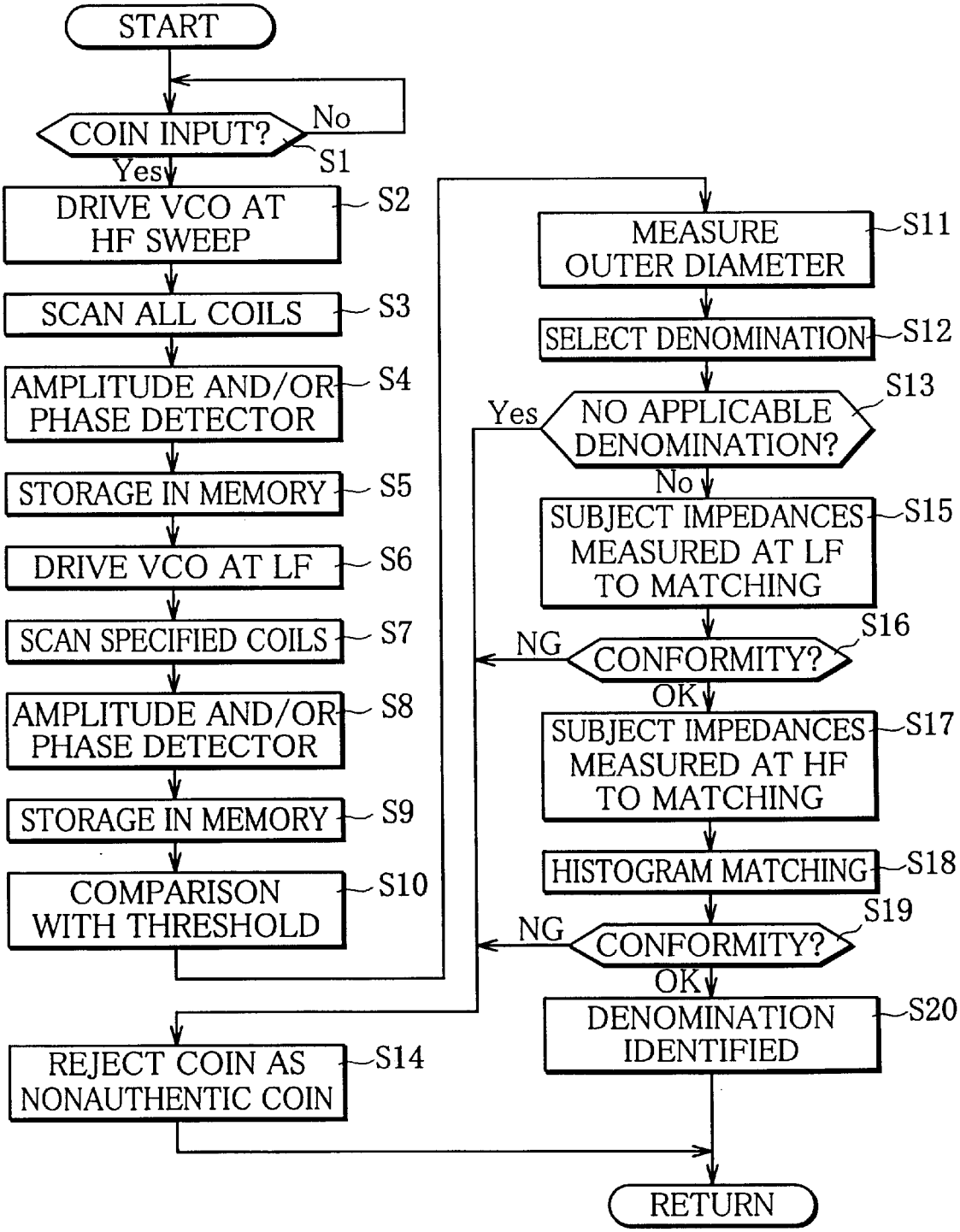
FIG. 9 is a chart schematically showing, by way of example, a procedure of a coin discrimination process executed by a microprocessor.

Referring now to FIG. 9, a coin discrimination process executed by the microprocessor 21 will be described. FIG. 9 schematically illustrates an example of a procedure for the microprocessor 21. This process is started upon detection of an input (insertion) of a coin 10 by means of various coin sensors (not shown) arranged in the coin passage [Step S1]. On detecting the input of a coin 10 which is an object of discrimination, the microprocessor 21 starts the controller 22, which then operates the voltage-controlled oscillator (VCO) 24 first at high frequency [Step S2] and controls the operation of the multiplexer 23 to successively excite all eddy current induction coils 2 of the coil array 1 at high frequency [Step S3]. Also, the controller 26 operates the amplitude and/or phase detector circuit 26 in synchronism with the high-frequency excitation of the eddy current induction coils 2, to successively sample and hold the impedances of the coils 2 measured via the amplifier 25 [Step S4]. The impedances of the individual eddy current induction coils 2 thus measured are successively stored in an internal memory (not shown) of the microprocessor 21 [Step S5], and this completes the process of obtaining information on the surface displacement irregularities of the coin 10 by means of high-frequency excitation of the eddy current induction coils 2.

Subsequently, the microprocessor 21 operates the voltage-controlled oscillator 24 at low frequency [Step S6], and controls the operation of the multiplexer 23 to successively excite only the specified eddy current induction coils 2*x* of the coil array 1 at low frequency [Step S7]. The amplitude and/or phase detector circuit 26 is operated in synchronism with the low-frequency excitation of these eddy current induction coils 2*x*, to successively sample and hold the impedances of the coils 2*x* measured via the amplifier 25 [Step S8]. The thus-measured impedances of the eddy current induction coils 2*x* are also successively stored in the internal memory (not shown) of the microprocessor 21 [Step S9]. This completes the process of obtaining information on the material of the coin 10 by means of low-frequency excitation of the eddy current induction coils 2*x*.

The microprocessor 21 then starts, as its internal process, a discrimination process for the coin 10 in accordance with the impedances of the eddy current induction coils 2 (2*x*) stored in its memory. In this discrimination process, first, the impedances of the eddy current induction coils 2 detected during the high-frequency excitation, for example, are compared with a predetermined threshold level, to sort out those coils 2 which showed no change in impedance and to detect their positions on the coil array 1 [Step S10]. Based on the information on the positions of the eddy current induction coils 2 which showed no change in impedance, those coils 2 which were facing the coin 10 at the time of the impedance measurement are identified to detect the profile (overall size) of the coin 10, and a maximum diameter is determined as the outer diameter of the coin 10 [Step S11]. Then, a table shown in FIG. 10, for example, which is prepared in the microprocessor 21, is looked up to select a denomination corresponding to the outer diameter of the coin 10 [Step S12].

Specifically, in the table are described, as reference data, information on the outer diameters and thicknesses of coins (true coins) of different denominations to be handled (to be discriminated), information on the materials of the coins (different impedances of the eddy current induction coil according to the materials), information on surface displacement irregularities of the stamp patterns of the coins (variations in impedance according to surface displacement irregularities), etc. By looking up the table, a denomination corresponding to the measured profile (outer diameter) of the coin 10 is selected. If no corresponding denomination is found [Step S13], the coin 10 is judged to be a coin which should not be accepted (nonauthentic coin) and is rejected [Step S14].

After a corresponding denomination for the coin 10 is selected, the impedances of the specified eddy current induction coils 2*x* detected during the aforementioned low-frequency excitation are read out from the memory and matched against information (material-dependent impedance of the eddy current induction coil) on the material of the corresponding denomination described in the table [Step S15]. In this case, the impedances of the four specified eddy current induction coils 2*x* are added together or averaged to obtain a measured impedance, in accordance with the method of obtaining the information (impedances of the eddy current induction coil) on the materials of the coins described in the table, and the measured impedance is compared with a corresponding impedance stored in the table. By performing the impedance matching process in this manner, a determination is made as to whether or not the coin 10 to be discriminated, of which the denomination is selected based on the outer diameter as described above, has conformity also in respect of the material [Step S16]. If, as a result of the impedance matching process, no conformity is found, that is, the material of the coin 10 is found to be different from that of the coin to be accepted, the coin 10 is judged a nonauthentic coin and rejected [Step S14].

If conformity of material is found in the matching process, a discrimination process is then performed based on the information on the surface displacement irregularities of the stamp pattern on the surface of the coin 10. This process is started by first reading out the impedances of the individual eddy current induction coils 2 detected during the high-frequency excitation and creating a histogram of the thus-read impedances [Step S17]. To create such a histogram, the impedances of the eddy current induction coils 2 are classified into a plurality of preset impedance ranges according to their magnitude, and the number of eddy current induction coils 2 whose impedance falls within a specified impedance range is counted. In the histogram, the impedance ranges are indicated along the abscissa and the respective numbers of eddy current induction coils 2 are indicated along the ordinate, so that the histogram shows a distribution of the impedances.

As mentioned above, the impedances of the individual eddy current induction coils 2 obtained during the high-frequency excitation show variations according to the distance d to the irregular surface of the coin 10, and the surface displacement irregularities on the surface of the coin 10 represent the stamp pattern. Accordingly, the impedances classified into the respective impedance ranges as described above indicate variations in the distance d, and consequently the degree of surface displacement irregularities on the surface of the coin 10. The histogram therefore represents a distribution of the surface displacement irregularities formed on the surface of the coin 10 as the stamp pattern.

The histogram created in this manner is matched against information on surface displacement irregularities of the stamp pattern of an acceptable coin stored in advance in the table (histogram of impedances dependent on surface displacement irregularities), more particularly, against a histogram for the denomination determined as described above [Step S19], to determine conformity in respect of the stamp pattern of the coin 10.

Figures 10, 11:
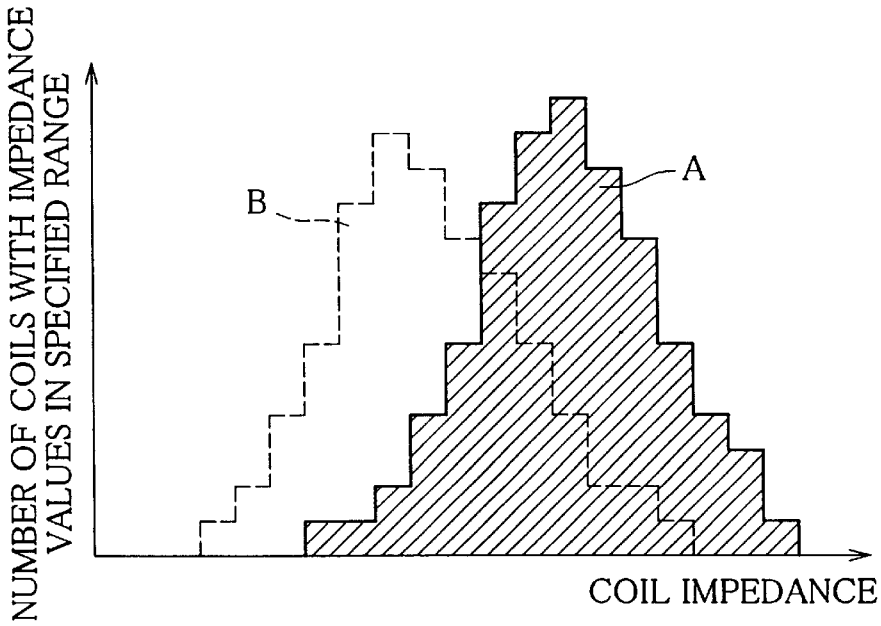
FIG. 10 is a diagram showing an example of a table storing coin information and used in the coin discrimination process.
FIG. 11 is a diagram showing examples of impedance histograms each indicative of a distribution of surface displacement irregularities of a stamp pattern on a coin.

Even if coins of different denominations have similar stamp patterns, generally there is a great difference in the surface displacement irregularities created by the stamp patterns as well as in the distribution of the surface displacement irregularities over the entire surfaces of the coins. Especially, where a coin 10 is falsified by making a hole to adjust its weight, the stamp pattern itself greatly changes and the distribution of the surface displacement irregularities also greatly varies. Namely, even if two coins, one acceptable and the other unacceptable, have similar outer diameters and similar stamp patterns, they exhibit noticeable differences as shown in FIG. 11; for example, the distribution (histogram B) of surface displacement irregularities of the unacceptable coin clearly differs from that (histogram A) of the acceptable coin in the position of the peak, spread width, deviation, etc. By comparing the histograms showing distributions of surface displacement irregularities with each other, therefore, it is possible to effectively determine the surface displacement irregularities of the stamp pattern on the surface of the coin 10, that is, the features of the stamp pattern.

If, as a result of the above histogram matching process, conformity is found as to the information on the surface displacement irregularities of the stamp pattern, a decision is made that the coin 10 is an authentic coin of the denomination determined as above [Step S20]. If conformity fails to be found in the histogram matching, the stamp pattern is judged improper, that is, it is concluded that the coin 10 differs from the acceptable one, and thus the coin 10 is rejected [Step S14].

The above matching process for the stamp pattern on the surface of the coin 10 by means of impedance histograms is preferably carried out with respect to the stamp patterns of both the obverse and reverse sides of the coin 10 by using two sets of information (impedances) detected by the two coil arrays 1 facing the both sides (obverse and reverse sides) of the coin 10, respectively.

With the above-described coin discriminating apparatus in which the material and outer diameter of a coin 10 as well as information on surface displacement irregularities of the stamp pattern on the coin surface are detected as variations in impedance of the eddy current induction coils 2 (2*x*), the denomination and authenticity of the coin 10 can be easily determined with accuracy based on these items of information, without being affected by dust or smudge adhering to the coin surface, unlike the apparatus in which information about the surface of the coin 10 is optically obtained. Further, since the impedances of the eddy current induction coils 2 (2*x*) themselves, which vary under the influence of the eddy current induced in the coin 10 by the alternating electromagnetic field applied thereto from the coils 2 (2*x*), are detected as information indicative of features of the coin 10, it is unnecessary to separately provide alternating electromagnetic field production coils and sensing coils, thus simplifying the arrangement of the sensing section. Accordingly, where information on the surface displacement irregularities of the stamp patterns on both the obverse and reverse sides of a coin 10 is to be obtained, two coil arrays 1 have only to be arranged so as to face the opposite sides of the coin 10, respectively, whereby the sensor arrangement is simplified.

Also, the eddy current induction coils 2 are excited at high frequency to induce eddy current in the surface region of a coin 10 and information on surface displacement irregularities of the coin surface is acquired based on variations in impedance of the coils 2; on the other hand, the eddy current induction coils 2*x* are excited at low frequency to induce eddy current in the inner part of the coin 10 and information on the material of the coin 10 is acquired based on change in impedance of the coils 2*x*. Thus, by only changing the excitation condition for the eddy current induction coils 2 (2*x*), for example, it is possible to effectively detect different features of the coin 10.

Further, the surface displacement irregularities of the stamp pattern on the surface of the coin 10 are detected as variations in impedance of the eddy current induction coils 2, and a histogram showing the impedance distribution is created, wherein the impedance ranges are indicated along the abscissa and the numbers of eddy current induction coils 2 showing impedances falling within the respective impedance ranges are indicated along the ordinate, to thereby extract features of the stamp pattern created by the surface displacement irregularities on the surface of the coin 10. The histogram is subjected to matching process; therefore, the coin 10 can be easily discriminated (collated) based on the features of the stamp pattern on the surface of the coin and the discrimination accuracy can be significantly enhanced. Also, the use of the histogram eliminates the need for a complicated process such as rotation of the information indicative of the stamp pattern for alignment, whereby the discrimination process can be greatly simplified and the time required for the processing can be shortened.

Figure 12:
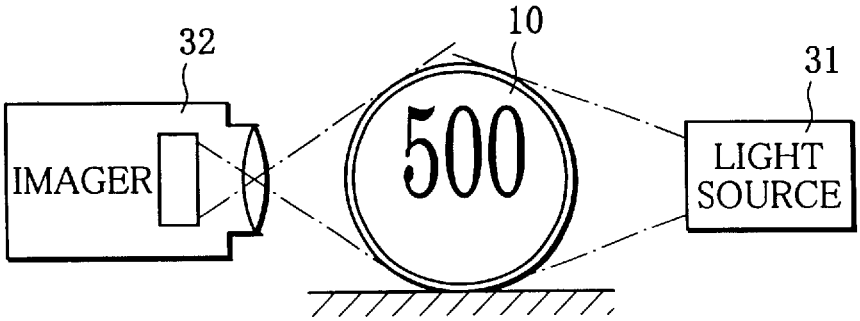
FIG. 12 is a schematic diagram of a principal part of a coin discriminating apparatus according to another embodiment of the present invention, illustrating the manner of optically detecting information on a coin surface by means of an imager.

In the embodiment described above, the surface displacement irregularities of a stamp pattern on a surface of a coin 10 are detected using the eddy current induction coils 2, but they may be detected optically. For example, as schematically shown in FIG. 12, a surface of a coin 10 is illuminated with light from a light source 31, and an image of the surface of the coin 10, which is the reflected light from the coin, is acquired by an imager (TV camera) 32 comprising a CMOS-CCD, for example. Luminance signals in the image signals thus acquired by the imager (TV camera) 32 are recognized (detected) as information on the surface displacement irregularities on the surface of the coin 10, and the coin 10 is discriminated based on the luminance signals.

Figure 13:
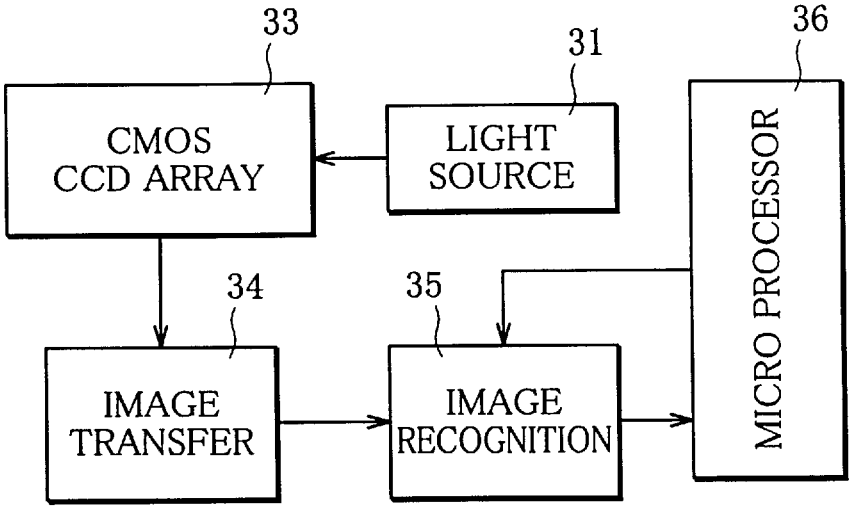
FIG. 13 is a schematic diagram illustrating functions of the coin discriminating apparatus using the imager appearing in FIG. 12.

In this case, the image signals obtained by scanning of the CMOS-CCD array 33 of the imager (TV camera) 32 are introduced to an image transform section 34 to be subjected to predetermined image processing, as shown in FIG. 13, for example, and in an image recognition section 35, luminance signals indicative of respective degrees of surface displacement irregularities on the surface of the coin 10 are extracted from the image signals. The luminance signals are then supplied to a microprocessor 36 where the luminance signals are classified into a plurality of preset ranges according to their signal level. Subsequently, a histogram is created which shows the luminance signal level along the abscissa and the numbers of pixels in the respective ranges along the ordinate, so that the histogram may be used as indicative of features of the stamp pattern which is created by the surface displacement irregularities on the surface of the coin 10.

Thus, surface displacement irregularities information is obtained based on the luminance information in the image of the surface of the coin 10 acquired by the imager (TV camera) 32, and a histogram of surface displacement irregularities distribution is created such that the luminance signal level and the numbers of pixels are indicated along the abscissa and the ordinate, respectively. The histogram exactly represents the features of the irregular stamp pattern on the surface of the coin 10, whereby the denomination and authenticity of the coin 10 can be easily determined with high accuracy when taken together with the measurement of coin size and the low-frequency eddy current impedance representing the coin composition, as in the foregoing embodiment.

Figure 14:
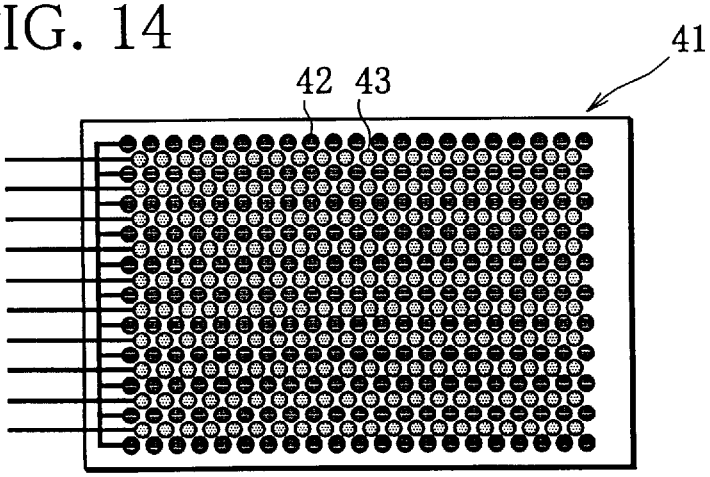
FIG. 14 is a diagram schematically showing the arrangement of a fiber-optic array used in a coin discriminating apparatus according to still another embodiment of the present invention.
Figure 15:
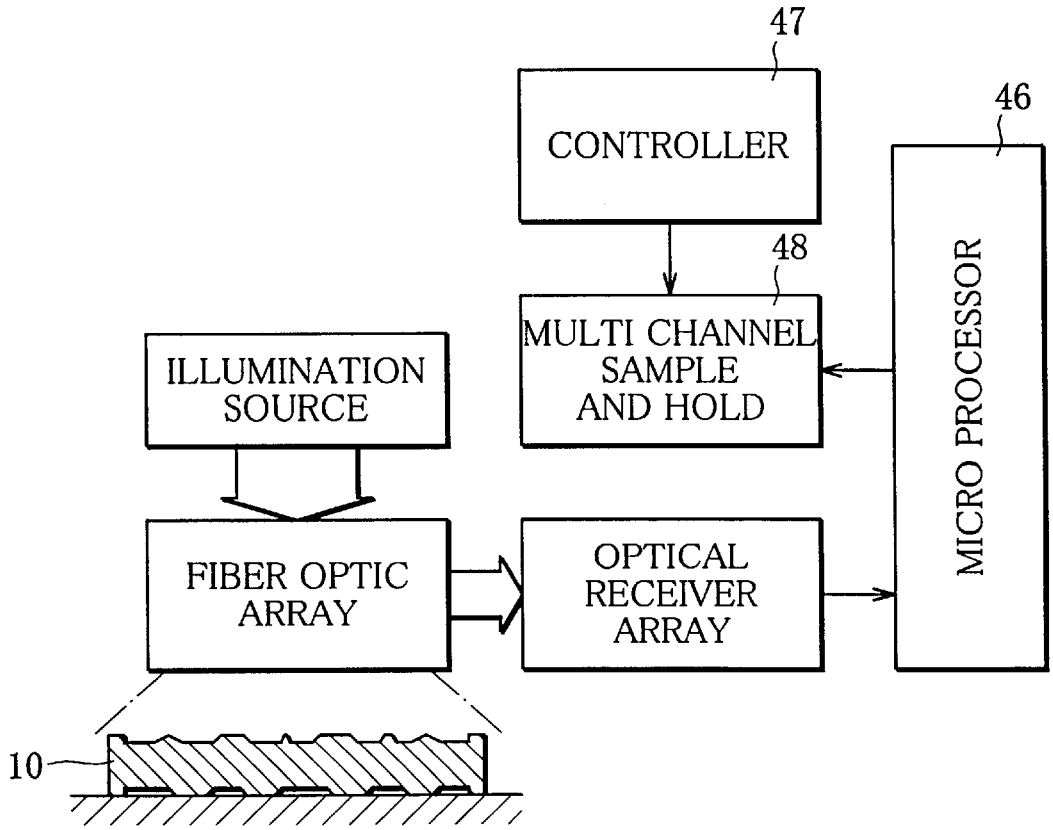
FIG. 15 is a schematic diagram illustrating functions of the coin discriminating apparatus using the fiber-optic array shown in FIG. 14.

The sensor for obtaining surface displacement irregularities information of a coin 10 may alternatively be implemented by a fiber-optic array 41 shown in FIG. 14, for example. The fiber-optic array 41, which is arranged so as to face a surface of a coin 10, comprises a plurality of light-emitting optical fibers 42 for illuminating the surface of the coin 10 with light guided thereto from a light source, and a plurality of light-receiving optical fibers 43 for receiving light rays reflected from the surface of the coin 10. The optical fibers 42 and 43 are closely arranged in a staggered fashion with a small gap therebetween, to form a light emitting and receiving surface. The light-emitting optical fibers 42 are connected to a light source 44, as shown in FIG. 15, and guide light from the light source 44 to illuminate the surface of the coin 10. The light rays reflected from the surface of the coin 10 are received by the light-receiving optical fibers 43 and introduced to a light-receiving element array 45 which includes a plurality of phototransistors etc. for detecting the intensities of the respective reflected light rays.

A controller 47, which is operated under the control of a microprocessor 46, controls the operation of a multichannel amplitude and/or phase detector circuit 48 such that the circuit 48 samples the intensities of the reflected light rays received via the respective light-receiving optical fibers 43 and detected by the light-receiving element array 45 and holds the sampled values, which are then collected by the microprocessor 46.

The microprocessor 46 classifies the intensities of the reflected light rays detected via the light-receiving optical fibers 43 into a plurality of preset intensity ranges and creates a histogram showing the reflected light intensity along the abscissa and the numbers of light-receiving optical fibers 43 in the respective intensity ranges along the ordinate. The created histogram is used as indicative of the features of the irregular surface displacements due to the stamp pattern on the surface of the coin 10.

Thus, the information on surface displacement irregularities of a surface of a coin 10 is obtained based on the intensities of light rays reflected from the coin surface and detected via the fiber-optic array 41, and a histogram of surface displacement irregularities distribution is created such that the reflected light intensity and the numbers of optical fibers 43 (numbers of optical sensors) are indicated along the abscissa and the ordinate, respectively. The histogram thus creates can a representation of the features of the irregular stamp pattern on the surface of the coin 10, whereby the denomination and authenticity of the coin 10 can be easily determined with accuracy, like the foregoing embodiments.

Figure 16:
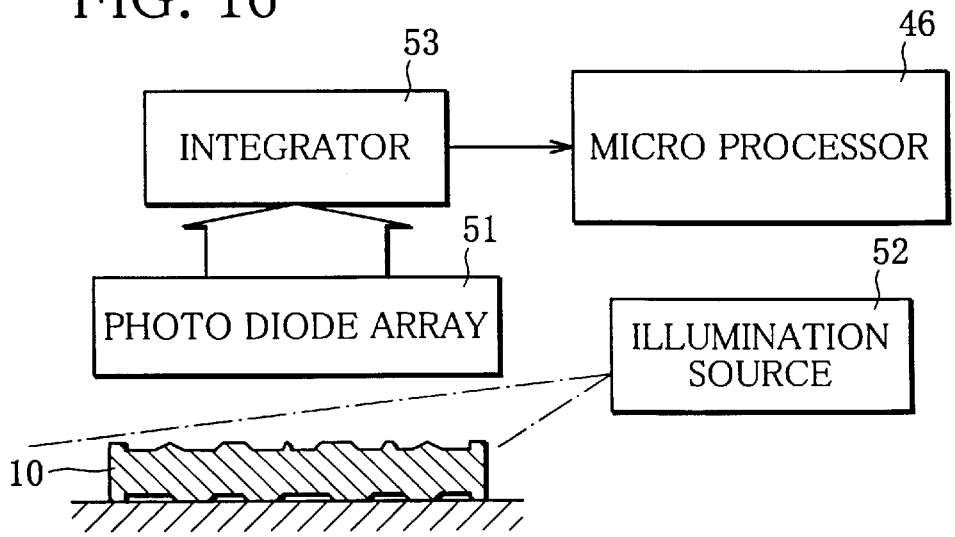
FIG. 16 is a diagram schematically showing the arrangement of a sensing section of a coin discriminating apparatus using a photodiode array.

Also, the information on surface displacement irregularities of a surface of a coin 10 may be obtained using a photodiode array 51 which comprises an array of photodiodes as light-receiving elements (optical sensors), as shown in FIG. 16. In this case, with the surface of the coin 10 diffusely illuminated by a light source 52 arranged obliquely in front of the coin, surface displacement irregularities information may be detected by means of the photodiode array 51. Preferably, the reflected light rays detected by the photodiode array 51 are integrated for a predetermined detection time by an integrator 53 before being output as detection outputs. Subsequently, the amounts of the light rays received by the respective photodiodes, which are indicative of the surface displacement irregularities on the surface of the coin 10, are classified into a plurality of ranges, and a histogram is created which shows the light reception amount along the abscissa and the numbers of photodiodes (optical sensors) in the respective ranges along the ordinate. The thus created histogram may be used as indicative of the features of the irregular stamp pattern on the surface of the coin 10.

Also in the case of optically detecting the features of an irregular stamp pattern on a surface of a coin 10, the aforementioned eddy current induction coils 2 excited at low frequency may be used in combination to determine the material of the coin 10, in which case the reliability of discrimination accuracy can advantageously be enhanced. Further, the profile (outer diameter) of a coin 10 may of course be checked using the optically detected information on the surface of the coin 10 so that the results can be used for the discrimination of the coin 10.

The present invention is not limited to the embodiment described above. For example, the information on surface displacement irregularities on both surfaces of a coin 10 obtained by exciting the eddy current induction coils 2 at high frequency may be used to obtain average distances $d_{ave1}$ and $d_{ave2}$ of the obverse and reverse surfaces of the coin 10 from the respective two coil arrays 1 (eddy current induction coils 2) arranged on opposite sides of the coin 10, as shown in FIG. 5, and using a distance D between the two coil arrays 1, a thickness t ($=D-d_{ave1}-d_{ave2}$) of the coin 10 may be obtained. The thickness t thus obtained may be compared with coin thickness information stored in the table, as an auxiliary step in the discrimination process.

Further, when acquiring information about the material of a coin 10 by exciting the eddy current induction coils 2*x* at low frequency, the excitation frequency may be varied in steps or continuously within a predetermined frequency range (e.g., 10 to 700 kHz) to measure impedances at different frequencies, and a pattern of frequency-dependent changes of impedance may be acquired to determine the material of the coin 10. In this case, when the eddy current induction coils 2*x* or large embedded coil are excited at low frequency, the oscillation frequency of the voltage-controlled oscillator 24 may be varied under the control of the controller 22.

Also, the number of eddy current induction coils 2 incorporated in each coil array 1, the pitch and pattern of arrangement of the coils 2, etc. may be determined as needed according to specifications of coins to be handled, and thus the present invention can be modified in various ways without departing from the scope and spirit thereof.

What is claimed is:

1. A coin discriminating apparatus for discriminating denominations of coins, comprising:

a sensor for obtaining information on surface displacement irregularities of a stamp pattern on a surface of a coin, said sensor including a plurality of first eddy current induction coils for applying electromagnetic fields for inducing eddy currents to the coin, and impedance measuring means for detecting a plurality of surface displacement irregularities information, said plurality of surface displacement irregularities information including detected impedances of the first eddy current induction coils that vary depending on the eddy currents induced in the coin;

histogram creating means for creating a created histogram indicative of a distribution of the surface displacement irregularities information obtained by said sensor; and pattern determining means for comparing the created histogram with a baseline histogram obtained before said created histogram and indicative of the distribution of surface displacement irregularities information of a true coin, to identify a denomination of the coin.

2. The coin discriminating apparatus according to claim 1, wherein said histogram creating means obtains a distribution of the detected impedances over an entire surface of the coin, the created histogram showing impedance along an abscissa thereof and numbers of first eddy current induction coils along an ordinate thereof.

3. The coin discriminating apparatus according to claim 1, wherein said plurality of first eddy current induction coils are arranged on a plane in matrix form to constitute a coil array, the coil array being arranged so as to face the surface of the coin.

4. The coin discriminating apparatus according to claim 1, further comprising:

a second eddy current induction coil for applying an electromagnetic field to the coin different from the electromagnetic fields for inducing eddy currents applied to obtain the surface displacement irregularities information;

impedance measuring means for detecting an impedance of said second eddy current induction coil that varies depending upon the eddy currents induced in the coin; and material determining means for comparing an impedance of said second eddy current induction coil detected when said second eddy current induction coil is excited at a predetermined frequency with a baseline impedance taken with respect to a true coin, to thereby determine a material of the coin.

5. The coin discriminating apparatus according to claim 4, wherein said second eddy current induction coil used to determine the material of the coin is a specified eddy current induction coil of said first plurality of eddy current induction coils which are excited to obtain the surface displacement irregularities information of the coin, said specified eddy current induction coil being selectively excited at low frequency, instead of high frequency, to induce an eddy current in the coin such that an impedance thereof is measured for determining the material of the coin.

6. The coin discriminating apparatus according to claim 1, further comprising coin thickness measuring means for measuring a thickness of the coin based on the impedances of said first eddy current induction coils detected when said eddy current induction coils are excited at a predetermined frequency.

7. The coin discriminating apparatus according to claim 1, further comprising coin diameter measuring means for measuring a diameter of the coin based on the impedances of said first eddy current induction coils detected when said eddy current induction coils are excited at a predetermined frequency.

* * * * *